US010694779B2

(12) United States Patent
Bodenchuk et al.

(10) Patent No.: US 10,694,779 B2
(45) **Date of Patent: *Jun. 30, 2020**

(54) PIPE LIGHTER HOLDER AND TOOL

(71) Applicant: Lifted Limited, LLC, Breckenridge, CO (US)

(72) Inventors: Matthew Robert Bodenchuk, Grand Junction, CO (US); Leslie Renea Bodenchuk, Grand Junction, CO (US)

(73) Assignee: Lifted Limited, LLC, Breckenridge, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/237,232

(22) Filed: Dec. 31, 2018

(65) Prior Publication Data

US 2019/0133183 A1 May 9, 2019

Related U.S. Application Data

(63) Continuation of application No. 15/921,059, filed on Mar. 14, 2018, now Pat. No. 10,201,183, which is a continuation of application No. 13/760,442, filed on Feb. 6, 2013, now Pat. No. 9,930,912.

(60) Provisional application No. 61/595,532, filed on Feb. 6, 2012.

(51) Int. Cl.
*A24F 9/02* (2006.01)

(52) U.S. Cl.
CPC ..... *A24F 9/02* (2013.01)

(58) Field of Classification Search
CPC .... A24F 9/02; A24F 9/14; A24F 13/24; A24F 13/26
See application file for complete search history.

(56) References Cited

U.S. PATENT DOCUMENTS

| | | | |
|---|---|---|---|
| 1,782,026 | A | 11/1930 | Beyer |
| 1,845,340 | A | 2/1932 | Ritz |
| 2,005,557 | A | 6/1935 | Penney |
| 2,043,888 | A | 6/1936 | Denit |
| 2,294,133 | A | 8/1942 | Leon |
| 2,460,427 | A | 2/1949 | Musselman et al. |
| 2,777,569 | A | 1/1957 | Starke, Jr. |
| 2,856,098 | A | 10/1958 | Heinrich |

(Continued)

FOREIGN PATENT DOCUMENTS

| | | | |
|---|---|---|---|
| GB | 209416 | A | 7/1924 |
| GB | 575451 | A | 2/1946 |

OTHER PUBLICATIONS

Final Office action dated Sep. 9, 2016 in U.S. Appl. No. 13/760,442, 8 pages.

(Continued)

*Primary Examiner* — Eric Yaary
(74) *Attorney, Agent, or Firm* — Kilpatrick Townsend & Stockton, LLP

(57) ABSTRACT

A standard smoking lighter slides into a hole on top of a plastic sheath so that only the top of the lighter is exposed. The bottom of the sheath has a hammer like protrusion at one end to stuff tobacco or other herb into a pipe. The opposite end of the bottom has a pivot point for a poker which serves to mix the herb and ash within the pipe and/or clean the debris from the pipe. The poker folds up into the sheath when not in use. Thus, a three function pipe tool provides a lighter, a stuffer and a poker.

20 Claims, 6 Drawing Sheets

(56) References Cited

U.S. PATENT DOCUMENTS

| | | | | |
|---|---|---|---|---|
| 3,200,822 | A | 8/1965 | Meyer | |
| 3,263,690 | A * | 8/1966 | Buckley | A24F 9/02 131/243 |
| 3,923,085 | A | 12/1975 | Nimer | |
| 4,043,348 | A | 8/1977 | Kanady | |
| 4,152,109 | A | 5/1979 | Schaffer | |
| 4,230,224 | A | 10/1980 | Weeks | |
| 4,318,416 | A | 3/1982 | Thornhill | |
| 4,342,902 | A | 8/1982 | Ping | |
| 4,600,022 | A | 7/1986 | Pierce, Jr. | |
| 6,693,850 | B2 | 2/2004 | Mulaw | |
| D548,883 | S | 8/2007 | Lin | |
| D586,953 | S | 2/2009 | Riggio | |
| D662,655 | S | 6/2012 | Bodenchuk et al. | |
| D739,600 | S | 9/2015 | Paramadilok | |
| D749,262 | S | 2/2016 | Schoenfeld | |
| D751,250 | S | 3/2016 | Vuong | |
| D806,946 | S | 1/2018 | Deahj | |
| 9,930,912 | B2 | 4/2018 | Bodenchuk et al. | |
| 10,201,183 | B2 | 2/2019 | Bodenchuk et al. | |
| 2008/0142026 | A1 | 6/2008 | Chou | |
| 2010/0065073 | A1 | 3/2010 | Sweeney | |
| 2010/0101591 | A1 | 4/2010 | Rosso | |
| 2013/0199548 | A1 | 8/2013 | Bodenchuk et al. | |
| 2014/0011144 | A1 | 1/2014 | Hancock et al. | |
| 2016/0183591 | A1 | 6/2016 | Thorne et al. | |

OTHER PUBLICATIONS

Non-Final Office action dated Jun. 6, 2017 in U.S. Appl. No. 13/760,442, 7 pages.

Toker Pokers by Toker Poker dated 2018. Found on Line [Jan. 14, 2019] https://tokerpoker.com/collections/toker-pokers, entire site.

Notice of Allowance dated Jan. 30, 2019 in U.S. Appl. No. 29/630,603, all pages.

* cited by examiner

PIPE LIGHTER HOLDER AND TOOL

CROSS-REFERENCE TO RELATED APPLICATIONS

The present application is a continuation of U.S. patent application Ser. No. 15/921,059 filed Mar. 14, 2018, which is a continuation of U.S. patent application Ser. No. 13/760,442 filed Feb. 6, 2013, which claims priority to U.S. Provisional Application No. 61/595,532 filed Feb. 6, 2012, the disclosures of which are incorporated herein by reference.

FIELD OF INVENTION

The present invention relates to a combination pipe/cigarette lighter holder, a pipe poker, used to clean the herb from the pipe and/or mix the herb and ash in the pipe, and a tobacco or an herb stuffer.

BACKGROUND OF THE INVENTION

Combination cigarette lighter holders and cigarette cases are well known in the art. Also known are lighter holders with pockets. Also known is a pipe lighter holder that actually forms a miniature pipe.

The traditional pipe smoker must use a lighter as well as a tobacco stuffer and a pipe poker to enjoy his pipe. What is needed in the art is a combination multi-tool and lighter holder.

The present invention provides a plastic case to hold a standard lighter. The case has a hammer shaped base on one side to serve as a tobacco or an herb stuffer. The other side of the base has a hinged poker to provide a metal rod to mix the tobacco or other herb and/or clean the pipe. When not in use the poker folds into the case.

SUMMARY OF THE INVENTION

The main aspect of the present invention is to provide a pocket sized sheath for a standard cigarette or smoking lighter, wherein the base of the sheath has a hammer like end and a folding poker end.

Other aspects of this invention will appear from the following description and appended claims, reference being made to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
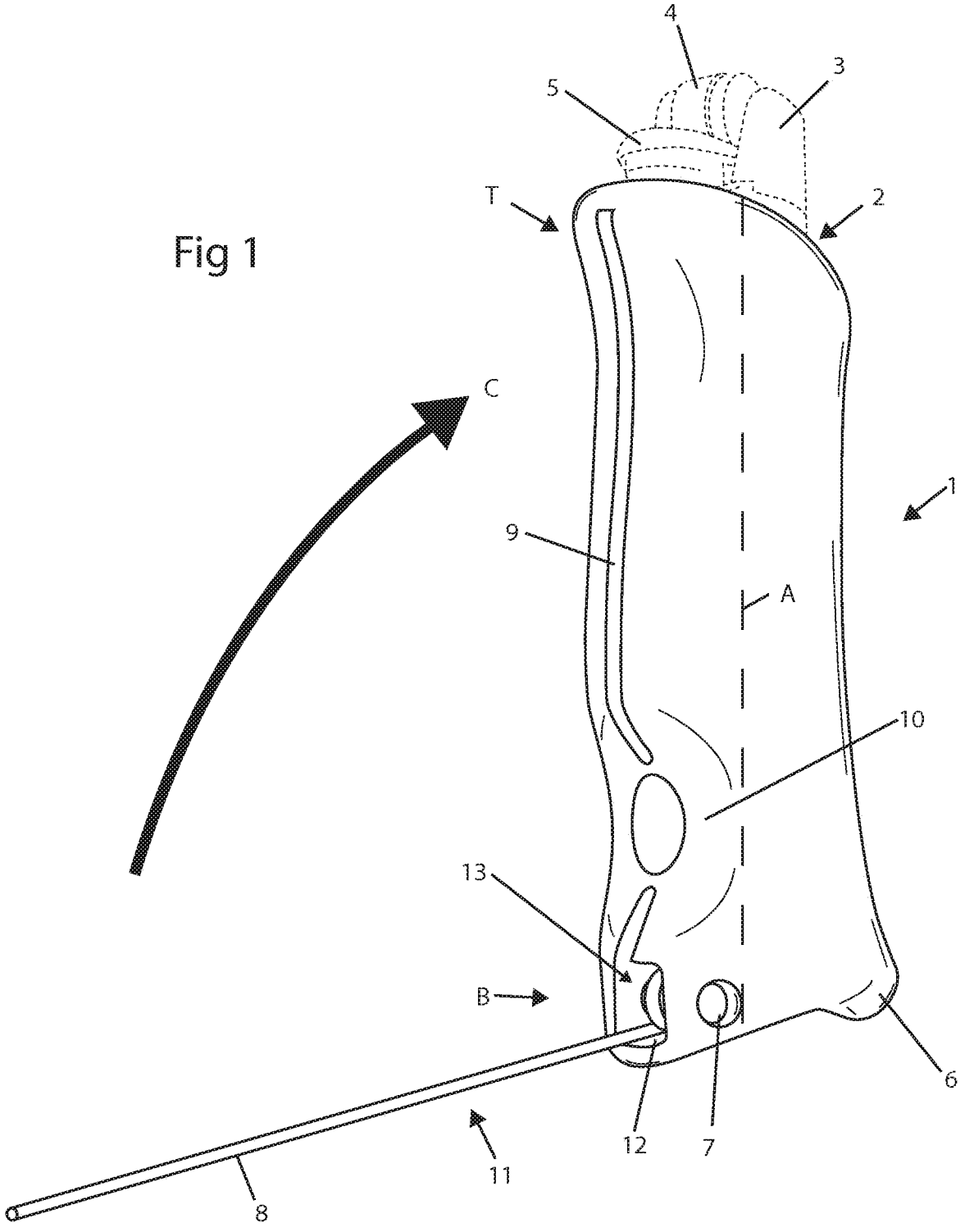
FIG. 1 is a top perspective view our lighter holder and tool showing a poker extended therefrom.

Referring first to FIG. 1 a pipe tool 1 is preferably made from a plastic mold. A central recess 2 at the top section T is sized to hold a standard smoking lighter 4 such as a BIC® lighter. The lighter 3 has a thumb actuator 4 and gas release button 5, all standard in the art. The bottom section B has a protrusion 6 which faces down and out from a central axis A of the pipe tool 1. Opposite the protrusion 6 is a pivot point 7 which secures the base of a foldable poker 8. The poker 8 is preferably a metal rod. Poker 8 folds in direction C into slot 9 in the passive mode. To move the poker 8 to the active mode shown, a recess 10 is provided to allow the user to pry up on section 11 of the poker 8. A ledge 12 at the base section B stops the poker 8 at about a 90° angle to axis A. A hole 13 allows the poker 8 to pivot around pivot point 7.

Figure 2:
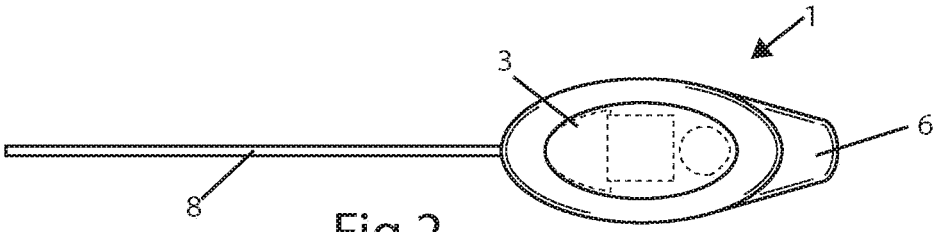
FIG. 2 is a is a top plan view thereof.
Figure 3:
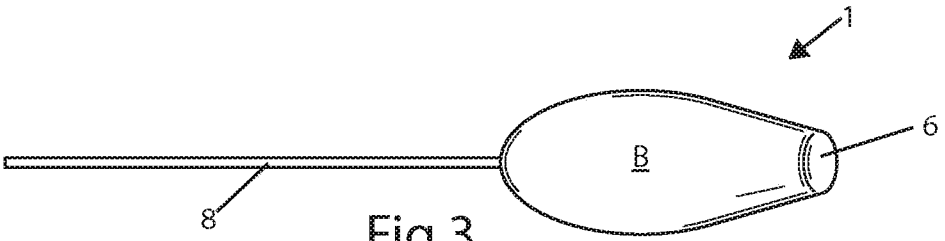
FIG. 3 is bottom plan view thereof.
Figure 4:
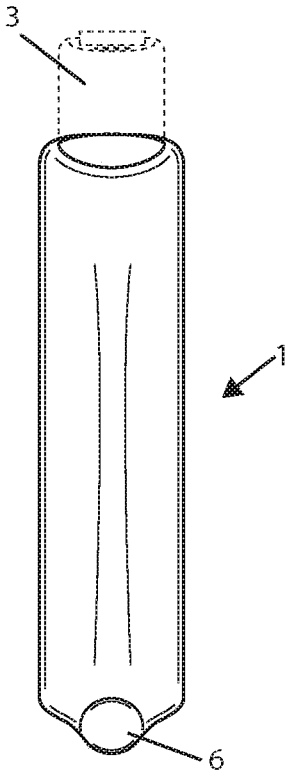
FIG. 4 is a rear elevational view thereof.
Figure 5:
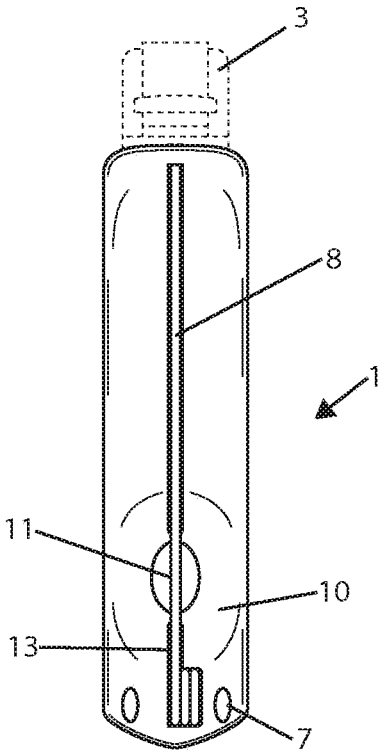
FIG. 5 is front elevational view thereof.

Referring next to FIGS. 2 and 3 the top and bottom views in the active mode are shown. FIG. 4 shows the protrusion 6 which is used as an herb stuffer when loading a pipe. FIG. 5 shows the passive mode in a front elevation view.

Figure 6:
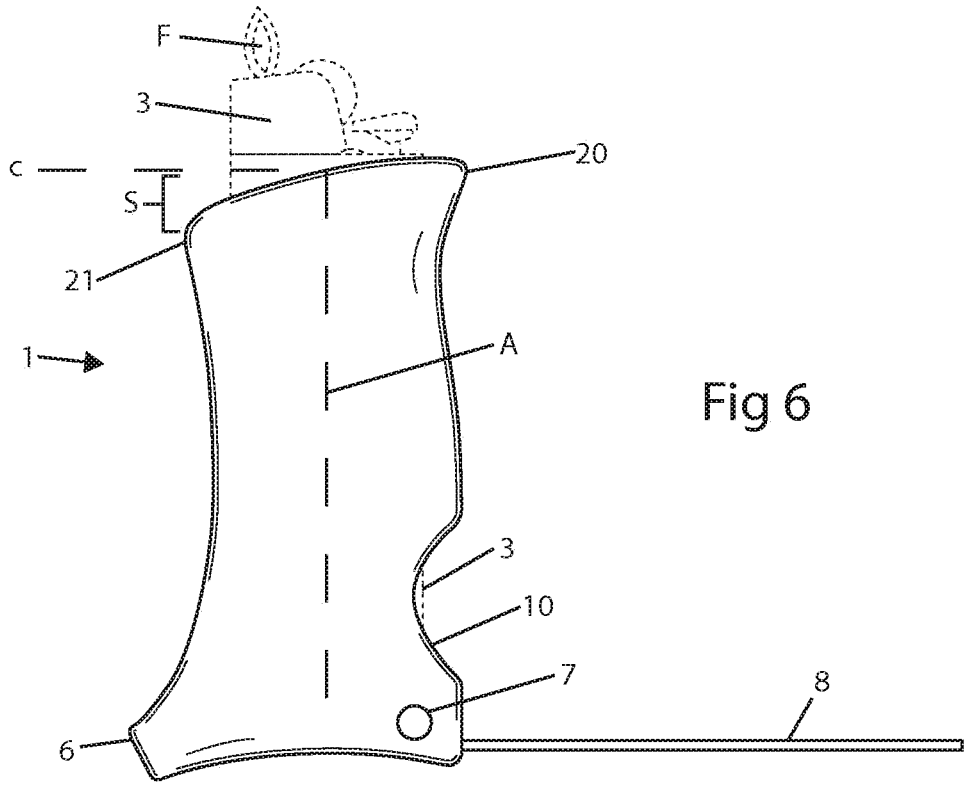
FIG. 6 is right side elevational view thereof.
Figure 7:
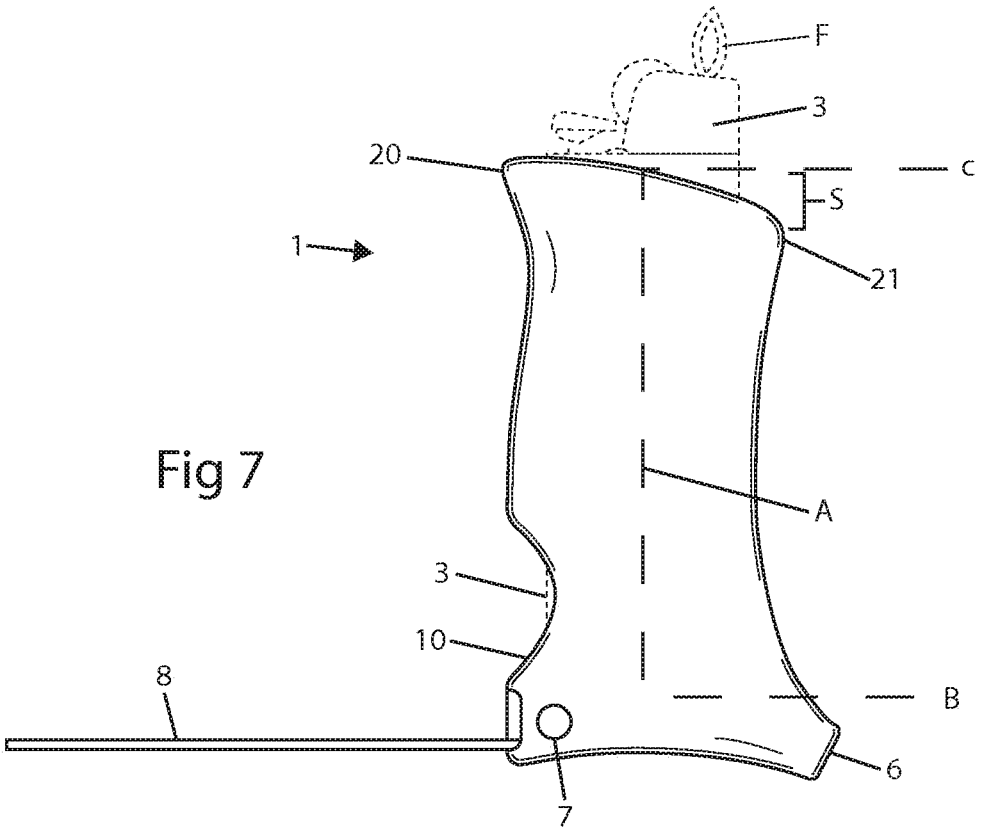
FIG. 7 is a left side elevational view thereof.

In FIGS. 6 and 7 the active mode of pipe tool 1 is shown. A horizontal line C is drawn at a 90° angle to axis A from the very top 20 of pipe tool 1. A space S is formed between the line C and the lower top segment 21. This body shape increases the distance from the flame F to the top segment 21 which allows a wide range of tilt angles for the pipe tool to be used without burning the pipe tool 1.

Figure 8:
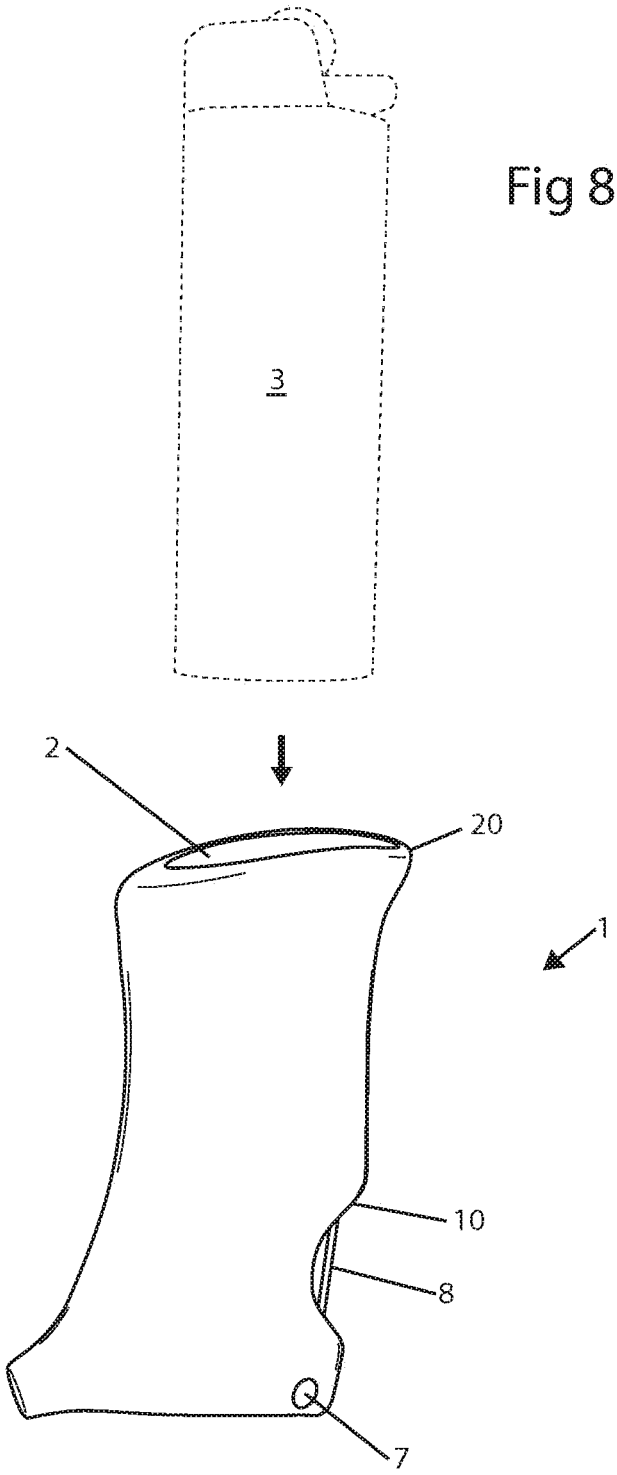
FIG. 8 is an exploded view of the invention.
Figure 9:
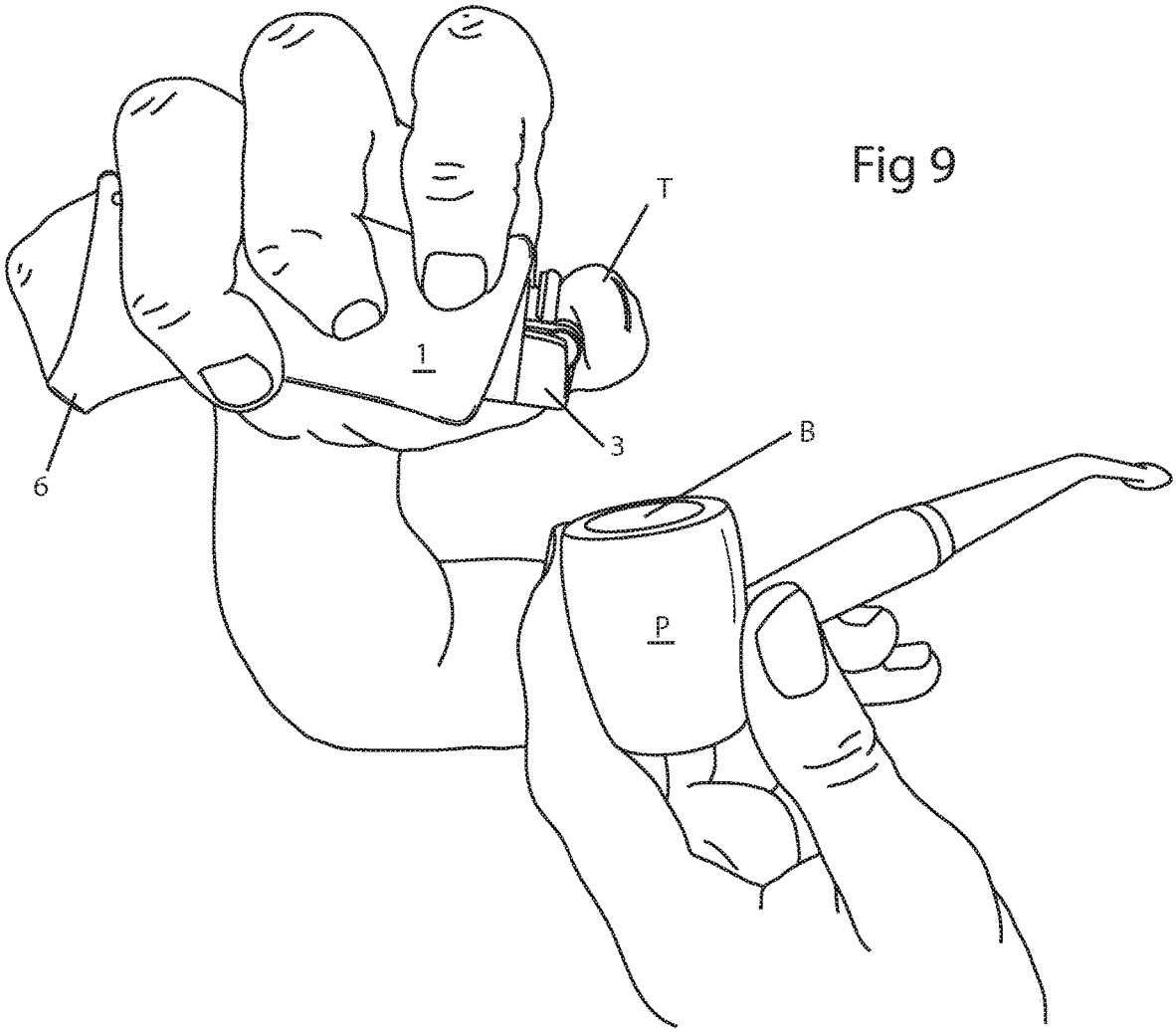
FIG. 9 is a front perspective view of the invention used as a lighter.

In FIG. 8 the central recess 2 is shown to be sized to firmly secure the lighter 3. In FIG. 9 the user's thumb T is about to light the tobacco or other herb (not shown) in the bowl B of pipe P.

Figure 10:
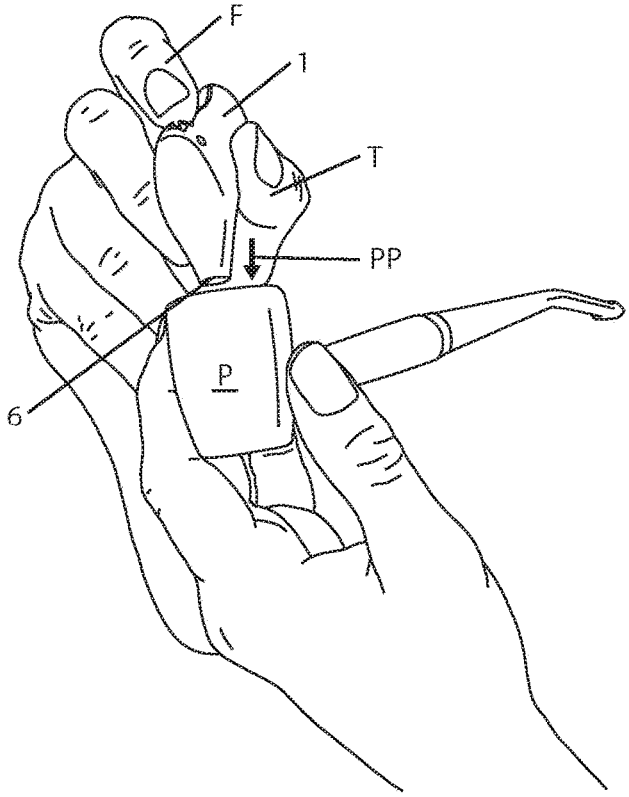
FIG. 10 is a side perspective view of the invention used as a stuffer.

In FIG. 10 the user's thumb T and index finger Fuse the end 6 to stuff down the tobacco or other herb (not shown) in direction PP.

Figure 11:
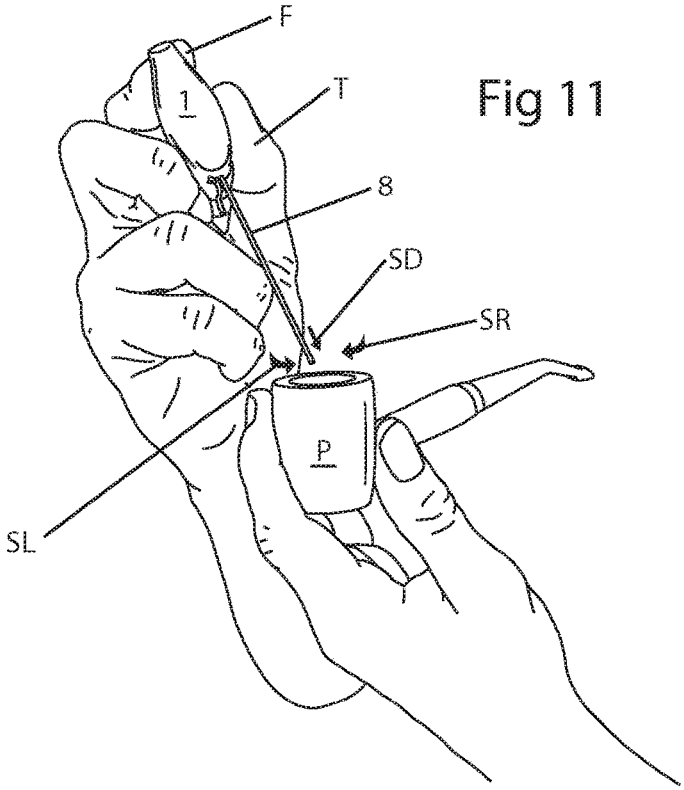
FIG. 11 is a front perspective view of the invention used as a poker.

In FIG. 11 the user's fingers, the thumb T and index finger F, support the pipe tool 1 so as to move the poker 8 in directions down SD, left SL and right SR. The poker 8 is in the active mode position.

Although the present invention has been described with reference to the disclosed embodiments, numerous modifications and variations can be made and still the result will come within the scope of the invention. No limitation with respect to the specific embodiments disclosed herein is intended or should be inferred. Each apparatus embodiment described herein has numerous equivalents.

What is claimed is:

1. A smoker's pipe tool, comprising:

a sheath, including an interior surface and an exterior surface, extending along a longitudinal axis, wherein:

the sheath includes a central recess extending along the longitudinal axis, the central recess is defined by the interior surface of the sheath and is sized to hold a lighter, the sheath includes a pipe bowl tamper sized to be insertable into a pipe bowl, and the sheath defines a slot extending along a length of the sheath;

an elongated poker having first and second end portions, wherein the elongated poker is moved from a closed position to an open position, wherein:

when the elongated poker is in the closed position, at least a portion of the elongated poker is disposed in the slot; and when the elongated poker is in the open position, the first end portion is insertable into a pipe bowl, and the second end portion is spaced from the pipe bowl when the first end portion is inserted into the pipe bowl.

2. The tool of claim 1, wherein:

the sheath defines a recess in the exterior surface, wherein the elongated poker extends through the recess when the elongated poker is in the closed position, and wherein the recess facilitates moving the elongated poker from the closed position to the open position.

3. The tool of claim 1, wherein:

the sheath includes a top surface that includes an opening of the central recess, wherein the top surface is not perpendicular to the longitudinal axis so that a flame from the lighter does not contact the sheath.

4. The tool of claim 1, wherein:

the sheath defines an inner geometric profile that conforms to an outer shape of a lighter so that the central recess firmly secures the lighter.

5. The tool of claim 1, wherein:

the slot is a longitudinal slot that extends substantially along the longitudinal axis.

6. The tool of claim 1, wherein:

at least a portion of the slot is formed between the interior surface and the exterior surface of the sheath.

7. The tool of claim 1, wherein:

at least a portion of the slot is formed in the sheath at a point inward of a distal most portion of the exterior surface.

8. The tool of claim 1, wherein:

the sheath includes an exterior recess that extends from the exterior surface to the interior surface such that the exterior recess exposes a lighter disposed in the central recess.

9. The tool of claim 8, wherein:

when the elongated poker is in the closed position, the at least a portion of the elongated poker contacts the sheath.

10. The tool of claim 1, wherein:

at least a portion of the elongated poker has a cross-sectional width that is substantially the same as a cross-sectional width of the slot so that the slot receives the elongated poker and so that a user must pry on the elongated poker to remove the elongated poker from the slot.

11. A method of using a smoker's pipe tool, the method comprising:

providing a smoker's pipe tool, the tool including:

a sheath, including an interior surface and an exterior surface, extending along a longitudinal axis, wherein:

the sheath includes a central recess extending along the longitudinal axis, the central recess is defined by the interior surface of the sheath and is sized to hold a lighter, the sheath includes a pipe-bowl tamper sized to be insertable into a pipe bowl, and the sheath defines a slot extending along a length of the sheath; and an elongated poker having first and second end portions, wherein the elongated poker is moved from a closed position to an open position, wherein:

when the elongated poker is in the closed position, at least a portion of the elongated poker is disposed in the slot; and when the elongated poker is in the open position, the first end portion is insertable into a pipe bowl, and the second end portion is spaced from the pipe bowl when the first end portion is inserted into the pipe bowl;

removing the elongated poker from the slot so that the elongated poker is in the open position;

inserting the elongated poker into a pipe bowl;

inserting the pipe-bowl tamper into the pipe bowl; and retracting the elongated poker to the closed position so that the elongated poker is disposed in the slot.

12. The method of claim 11, wherein:

the sheath defines a recess in the exterior surface, wherein the elongated poker extends through the recess when the elongated poker is in the closed position, and wherein the recess facilitates moving the elongated poker from the closed position to the open position.

13. The method of claim 11, wherein:

the sheath includes a top surface that includes an opening of the central recess, wherein the top surface is not perpendicular to the longitudinal axis so that a flame from the lighter does not contact the sheath.

14. The method of claim 11, wherein:

the sheath defines an inner geometric profile that conforms to an outer shape of a lighter so that the central recess firmly secures the lighter.

15. The method of claim 11, wherein:

the slot is a longitudinal slot that extends substantially along the longitudinal axis.

16. The method of claim 11, wherein:

at least a portion of the slot is formed between the interior surface and the exterior surface of the sheath.

17. The method of claim 11, wherein:

at least a portion of the slot is formed in the sheath at a point inward of a distal most portion of the exterior surface.

18. The method of claim 11, wherein:

the sheath includes an exterior recess that extends from the exterior surface to the interior surface such that the exterior recess exposes a lighter disposed in the central recess.

19. The method of claim 18, wherein:

when the elongated poker is in the closed position, the at least a portion of the elongated poker contacts the sheath.

20. The method of claim 11, wherein:

at least a portion of the elongated poker has a cross-sectional width that is substantially the same as a cross-sectional width of the slot so that the slot receives the elongated poker and so that a user must pry on the elongated poker to remove the elongated poker from the slot.

* * * * *